US005425555A

United States Patent [19]

Beange

[11] Patent Number: 5,425,555

[45] Date of Patent: Jun. 20, 1995

[54] SPECIALIZED MENU HOLDER

[76] Inventor: Norman C. Beange, 39 Boyd Court, Markham, Ontario L6K 1A6, Canada

[21] Appl. No.: 275,510

[22] Filed: Jul. 15, 1994

[51] Int. Cl.[6] ..... B42D 15/00

[52] U.S. Cl. ..... 283/107; 283/61

[58] Field of Search ..... 283/107, 108, 109, 61, 283/62; 402/79; 281/2, 5, 38, 40

[56] References Cited

U.S. PATENT DOCUMENTS

| | | | |
|---|---|---|---|
| 4,183,554 | 1/1980 | Howard, Jr. | 283/107 |
| 4,640,030 | 2/1987 | Wood et al. | 283/107 X |
| 4,965,948 | 10/1990 | Reubens | 402/79 X |
| 5,316,404 | 5/1994 | Hensel | 402/79 |

*Primary Examiner*—Willmon Fridie

[57] ABSTRACT

A unique menu structure is provided so that front and rear laminate sheets overcome a paper sheet which carries indicia, along one margin of the laminate sheets the sealed laminate sheets extend a pre-determined distance and define a plurality of apertures therein. Vinyl sheets are formed so as to have pockets which allow cards to be inserted in the pockets for the purposes of changing daily menu specials, for instance, one for beverage specials and one for food specials. The vinyl sheets have extended lip or margin, one of which overcovers the front laminate sheet along the apertured margin and the other over the rear laminate sheet along the apertured margin and the vinyl sheets are heat sealed so that they seal relative to each other through the apertures. A menu is therefore fashioned which has a permanent and washable surface carrying the menu in the laminate sheet region while the vinyl pocket region provides for menu changes or specials.

5 Claims, 2 Drawing Sheets

SPECIALIZED MENU HOLDER

BACKGROUND TO THE INVENTION

In the restaurant trade, menus are used to display the table of fare. In order to obtain longevity to the menu, they are printed either on glossy or coated stock with weight greater than approximately 24 lbs., generally in the vicinity of 60 to 180 lbs. Even these menus, after extensive use, become tattered or soiled or both.

In order to overcome this problem, it has been customary now to produce a menu printed on lighter paper stock, say 20 to 24 lbs., and to laminate the same between two laminate plastic sheets. The menu is thus prevented from being soiled because the menu laminate may be wiped off and cleaned simply by a wet cloth.

When the restaurant wants to display "daily specials", the daily special is generally typed up on a small sheet or card and paperclipped onto the menu face or in the menu fold, as the case might be. The paperclip tends to fall off and the daily special is lost.

One means of overcoming the problem is to provide a foldable pocket wherein the fixed menu is placed within a larger pocket or fold and the pocket extends laterally outward from the edge to form one or more additional pockets, generally of smaller size, into which the daily special card may be placed. These types of menus are rather cumbersome primarily because bias taping is used around the edges of each surface of the pocket and thus, increases the weight cumbersomeness of the fixed and daily menu display.

It is an object of this invention to provide a menu holder or structure which allows a fixed menu to be displayed and protected from grime, wetness and the like while at the same time, at least along one edge thereof providing pockets into which may be displayed a daily menu wherein the daily menu also is protected because the pocket itself is of sheet of plastic.

There is a problem with such structure if made, for instance, of two sheets of laminate plastic in that the sheets which overcover and undercover the fixed menu may be effectively laminated as will hereinafter be better described, but the pocket areas for the removable daily menu, after a period tend themselves to bind so that the pocket seals closed and cannot be used.

The problem is further complicated by the fact that only certain types of sheet plastics are laminate quality and capable of being laminated by heat in order to envelope a fixed menu while other sheet plastics, such as poly-vinyl-chloride sheets or mylar® sheets can provide a pocket which will not ever seal so that the daily menu can be removed and a new one inserted.

THE INVENTION

The invention further contemplates a menu structure where front and rear laminate sheets overcome a paper sheet which carries indicia, along one margin of the laminate sheets the sealed laminate sheets extend a predetermined distance and define a plurality of apertures therein. Vinyl sheets are formed so as to have pockets which allow cards to be inserted in the pockets for the purposes of changing daily menu specials, for instance, one for beverage specials and one for food specials. The vinyl sheets have extended lip or margin, one of which overcovers the front laminate sheet along the apertured margin and the other over the rear laminate sheet along the apertured margin and the vinyl sheets are heat sealed so that they seal relative to each other through the apertures. A menu is therefore fashioned which has a permanent and washable surface carrying the menu in the laminate sheet region while the vinyl pocket region provides for menu changes or specials.

The invention further contemplates a menu structure comprising a front and rear laminate sheet overcovering an interceding indicia carrying sheet having a perimeter, and upon which there is adapted to be placed indicia, the laminate sheets sealingly attached to each other around the peripheral of the indicia sheet margins, one margin of which extends a pre-determined distance wherein there is defined a plurality of apertures spatially disposed therealong and, a first and second vinyl sheet having at least one sealing margin along one side, the first vinyl sheet overlaying the front laminate, the second vinyl sheet overlaying the rear laminate, along the aperture margin, the vinyl sheets being welded to each other through the apertures along said margin, whereby they are relatively bonded.

Particularly, the menu structure just identified has at least one vinyl pocket sealed along at least three sides, one of the sides welded through the apertured laminate margin, but the vinyl sheets may define more than one pocket, for instance, two or more. Further, the menu structure can also provide a second pair of vinyl sheets on an opposite extended laminate apertured margin, if desired, to carry further vinyl pockets.

BRIEF DESCRIPTION OF THE DRAWINGS

The invention will now be described by way of example and reference to the accompanying drawings in which.

Figure 1:
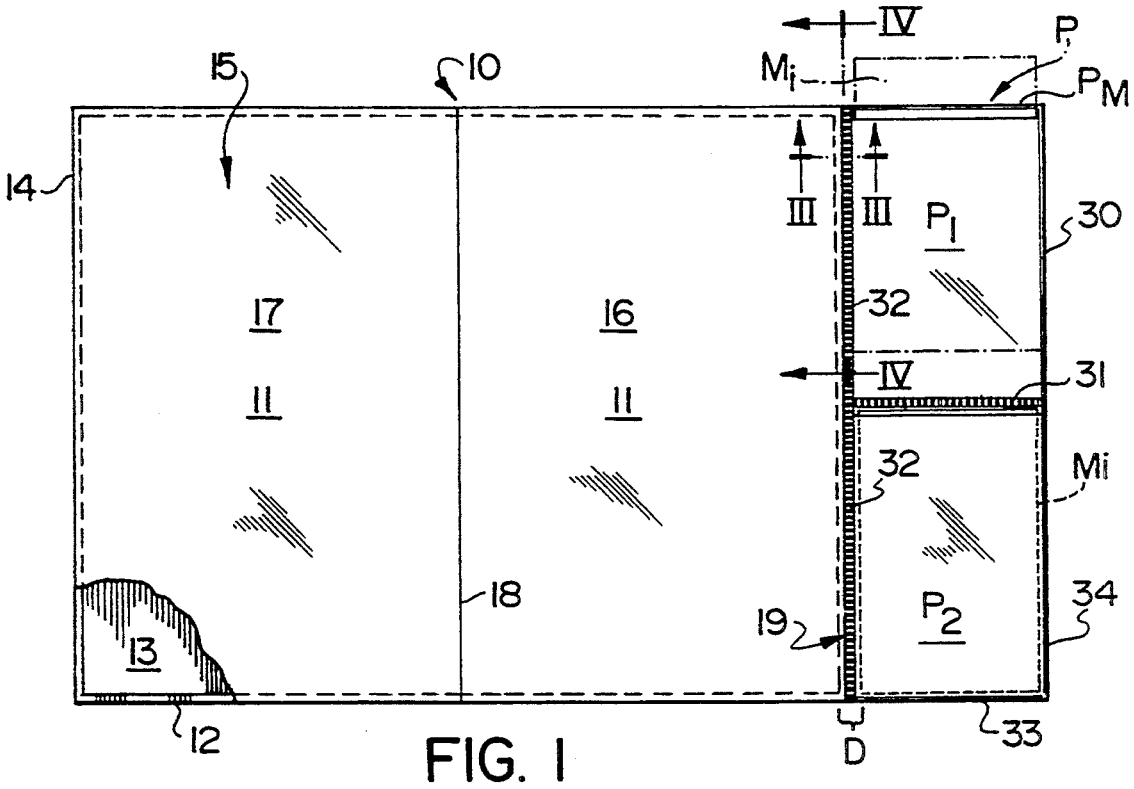
FIG. 1 is an open plan view of a menu holder, according to the invention.

According to the invention, and now referring to FIG. 1, a menu structure (10) is shown consisting of a front laminate sheet (11), a rear laminate sheet (12) overcovering a paper sheet (13) upon which there is indicia of the permanent menu for the restaurant. The indicia is not shown in any of the drawings. The forward laminate sheet (11) and the rearward laminate sheet (12) confines the paper sheet (13) by a laminate sealed peripherally around the same, shown as (14) so as to form a sealed laminate portion (15) consisting of two folded panels (16) and (17) which can be folded along a foldline (18).

One lateral or side margin of the laminate portion (15) extends into a broader seam referenced (19) which has a width (D).

The laminate sheet (11) and (12) may be a polyethylene, polyethylene Co-Polymers, and polyester which are available either in sheets or, rolls and as manufactured by Sealtran of Chicago, Ill. in the U.S.A. and sometimes sold under the trademark TRANSKOTE LAMINATING FILM®.

Figure 2:
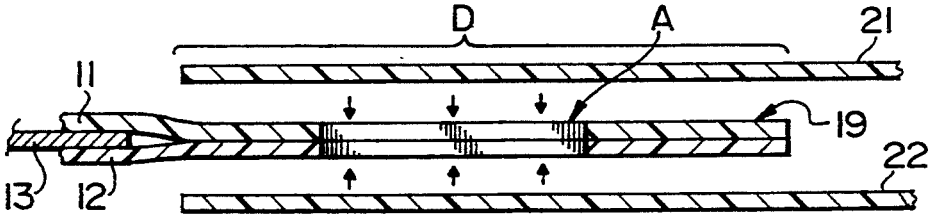
FIG. 2 is a partial cross-section prior to full assembly view of the pocket seam region of the menu holder, according to the invention, i.e., along the same cross section as the assembled cross section view of FIG. 3.

The laminate portion (15) is constructed using the normal laminating steps known in the prior art, by using two laminating sheets (11) and (12) and interspacing paper sheet (13) with the indicia thereon and then heat treating by a normal laminator. What is important is that one of the margins or marginal seal strips (19) has sufficient dimension, which is shown in FIGS. 1 and 2 as dimension (D), so a plurality of spatially disposed rectangular apertures may, after laminating, be spatially punched along the seal strip (19).

Along this seal (19) dimensioned (D), a plurality of spatially disposed apertures (A) are punched. Preferably the apertures are rectangular approximately 3 mm wide by 5 mm long and the seal width dimension (D) is about 10 mm.

Figure 5:
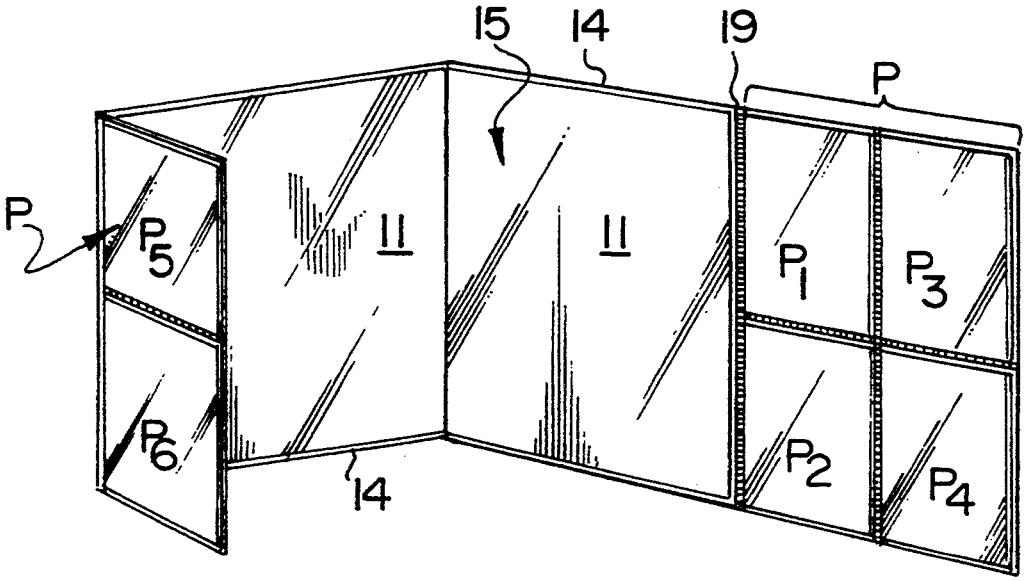

Pocket areas, generally shown as (P), in FIG. 1 show two pockets ($P_1$) and ($P_2$), and in FIG. 5 , four pockets ($P_1$) through ($P_4$).

The pocket regions (P) provide an itinerant menu (M), which in FIG. 1 consists of two itinerant menus ($M_1$) and ($M_2$), each respectively placed in pockets ($P_1$) and ($P_2$), while in FIG. 5, four of them in pockets ($P_1$) through ($P_4$). The itinerant menus (M) are really the daily menus and are printed normally on paper with the appropriate indicia describing the daily menu and slipped into one of the pockets ($P_1$) through ($P_4$) of the pocket region (P).

Figure 3:
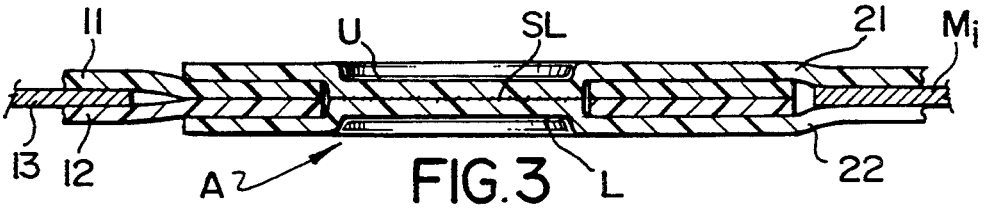
FIG. 3 is an assembled cross section along lines III—III of FIG. 1.
Figure 4:
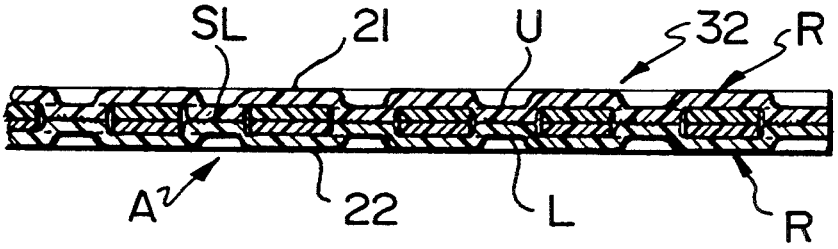
FIG. 4 is an assembled cross sectional view orthogonal to that of FIG. 3, along lines IV—IV if FIG. 1; and, FIG. 5 is a perspective view of yet another menu structure where two of the novel seams of FIGS. 2 and 3 and 1 are used.

The pocket region (P) is constructed of two polyvinyl-chloride, PCV, sheets (21) and (22), more clearly shown in the cross-sectional FIGS. 2, 3 and 4. The PCV sheets, when in juxtaposition, do not adhere to each other, when at normal room temperatures, whereas laminate sheets, for instance, those of (11) and (12) will eventually "seal" and therefore will not allow the itinerant menus ($M_i$) to be slipped into and out of the respective pockets (P) on a daily basis.

One wants therefore, to have the laminate portion (15) "sealed" but the pocket portion adapted to at least have one margin (PM) open so that the menu (M) may be slipped into and out of the pocket. Thus, the pocket will have a seal around three of its sides (30), (31) and (32), for instance in pocket ($P_{1'}$) and (32), (33) and (34) for ($P_2$). There is a chemical inconsistency between a PVC (21) and (22) on the one hand and laminate sheets (11) and (12) on the other. A PVC sheet when heat treated as by heat press will not "seal closed" onto a laminate sheet but will "seal closed" to another polyvinyl-chloride sheet. Thus, seams (30), (31) (34) and (33) seal upon themselves to provide side and bottom sealing margins, respectively, for pocket ($P_1$) and ($P_2$). The seam (32) however, will not seal to either of the laminate sheets (11) and (12). Thus, the apertures (11) are punched into marginal seal (19) which is respectively composed of the two laminate sheets adhering one to another. The PVC sheets (21) and (22), and now referring to FIG. 3 and 4, will seal to each other as shown along seal line (SL) but only in the aperture area (A). This bond can be achieved by heat sealing because the PVC sheet when heated, as is known in the prior art, will adhere to each other but not to the laminate sheets.

In order to provide a visually aesthetic "seam" along the seam interface (32)-(19), the upper and lower surfaces of the vinyl sheets (21) and (22), respectively shown as (U) and (L) in FIGS. 3 and 4, are "knurled" and the upper and lower surface (32) of the seam therefore appear to be consistent and regular. One in fact cannot see the apertures (A) along this seal face. For that reason, it is preferred that the heat seal (31) being the bottom of the pocket ($P_y$) be also knurled which is shown in FIG. 1 as such. One could also knurl the seams (30), (34) and (33) but that is not shown as such in FIG. 1.

Therefore, in fabricating the pocket region (P) the same is fabricated from two polyvinyl-chloride sheets (21) and (22) overlaid, in part, over the aperture after the lamination of the laminate portion (15), this being shown in the assembly cross-sectional FIG. 2.

The seam (19) is then overheated once again with knurled surface heating platens against each of vinyl sheets (21) and (22) to create the upper and lower knurl sealing strip (SL) from the covers (U) and (L) in each aperture area (A).

Referring the perspective FIG. 5, the menu is shown having pockets ($P_1$) through ($P_4$) at one edge and pockets ($P_5$) and ($P_6$) along the other margin. The fabrication steps are similar to those aforesaid.

It will apparent to those skilled in the art that in fact, the menu can be constructed or configured in any other fashion, for instance, there could be two laminate portions (15) consisting of two panels (16) and (17), respectively, respectively sealed along the fold-line (18) so as to form four panels of eight sides for the permanent menu.

I claim:

1. A menu structure comprising:

(a) a front and rear laminate sheet, an interceding indicia carrying sheet having a perimeter of indicia sheet margins, and upon which there is placed indicia, the laminate sheets sealingly attached to each other around the peripheral of the indicia sheet margins, one margin of which extends a predetermined distance wherein there is defined a plurality of apertures spatially disposed therealong; and, (b) a first and second vinyl sheet having at least one sealing margin along one side, the first vinyl sheet overlaying the front laminate, the second vinyl sheet overlaying the rear laminate, along the aperture margin, the vinyl sheets being welded to each other through the apertures along said margin, whereby they are relatively bonded.

2. A menu structure comprising:

(a) a front and rear laminate sheet overcovering an interceding sheet upon which there is indicia, the laminate sheets sealingly attached to each other around the peripheral of the indicia sheet, a portion of the peripheral defining a margin that extends a pre-determined distance and there is defined therein a plurality of apertures spatially disposed along the margin; and, (b) two vinyl sheets having a sealing margin along three sides so as to define a pocket, the vinyl sheet along one of the sides overlaying respectively, front and back laminate sheets along the margin, the same being welded to each other through said apertures, whereby they are relatively bonded.

3. The menu structure as claimed in claim 2, wherein the laminate sheets extend beyond the indicia sheet to define two margins with spatially disposed apertures, and there are two pairs of vinyl sheets, one welded along one of said margins, the other welded along the other of said margins.

4. The menu structure as claimed in claim 2, wherein the two vinyl sheets define at least one pocket.

5. The menu structure as claimed in claim 2, wherein each pair of vinyl sheets define at least one pocket.

* * * * *